United States Patent [19]

Allen

[11] 3,947,987

[45] Apr. 6, 1976

[54] ROTATABLE POSTER DISPLAY UNIT

[75] Inventor: Robert E. Allen, Saratoga, Calif.

[73] Assignee: Bemiss-Jason Corporation, Palo Alto, Calif.

[22] Filed: Nov. 5, 1973

[21] Appl. No.: 413,086

[52] U.S. Cl. ..... 40/68; 40/77.8

[51] Int. Cl.[2] ..... G09F 11/02

[58] Field of Search ..... 40/143, 68, 77.8, 140, 40/124, 126 A, 124.2, 124.4, 125 F, 125 H

[56] References Cited

UNITED STATES PATENTS

| | | | |
|---|---|---|---|
| 259,771 | 6/1882 | McLoughlin | 40/77.8 |
| 1,455,474 | 5/1923 | Brown | 40/140 X |
| 1,573,898 | 2/1926 | Armstrong | 40/125 F |
| 2,002,734 | 5/1935 | Ferril | 40/126 A |
| 2,028,506 | 1/1936 | Enoch | 40/126 A |
| 2,044,422 | 6/1936 | Davdson | 40/126 A |
| 3,314,177 | 4/1967 | Mies et al. | 40/124 |
| 3,382,594 | 5/1968 | Volger | 40/68 |
| 3,841,009 | 10/1974 | Mohrlock | 40/126 A |

FOREIGN PATENTS OR APPLICATIONS

| | | | |
|---|---|---|---|
| 654,741 | 6/1963 | Italy | 40/124.4 |
| 106,372 | 5/1917 | United Kingdom | 40/143 |
| 542,951 | 5/1922 | France | 40/77.8 |

*Primary Examiner*—Louis G. Mancene
*Assistant Examiner*—Wenceslao J. Contreras
*Attorney, Agent, or Firm*—Townsend and Townsend

[57] ABSTRACT

A poster display unit having a central core provided with means for mounting the same for rotation about a predetermined axis. A sheet of corrugated material wrapped around the core and releasably held at its opposed, outer marginal edges thereto permits posters to be secured by fasteners, such as pins or the like, to the sheet and the sheet can be of any one of a number of different colors or designs. The core itself may be of cardboard material to permit pins to extend into the same. In a preferred embodiment, the unit is mounted for rotation about a vertical axis.

2 Claims, 3 Drawing Figures

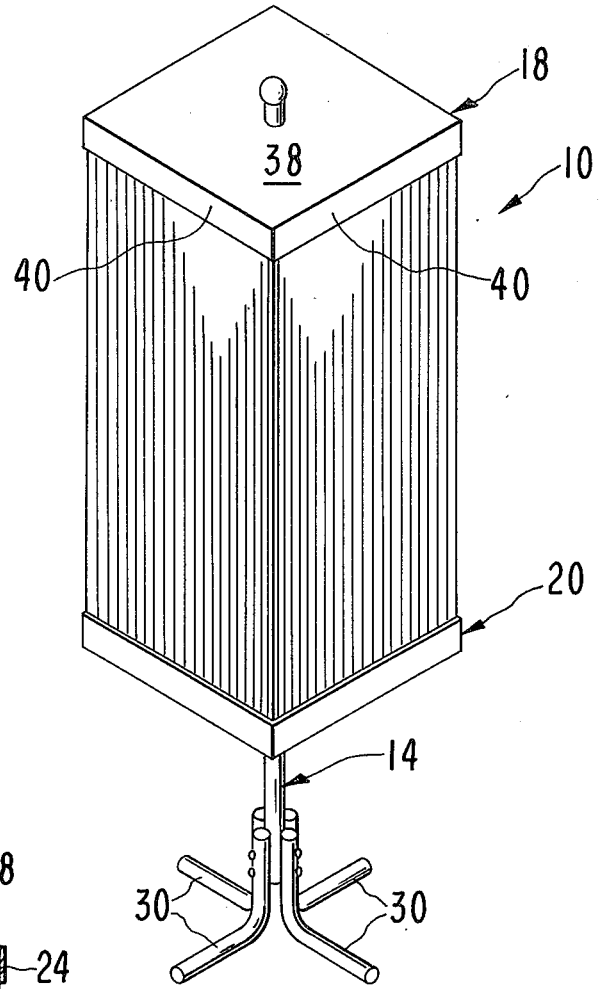
FIG. 1
FIG. 2
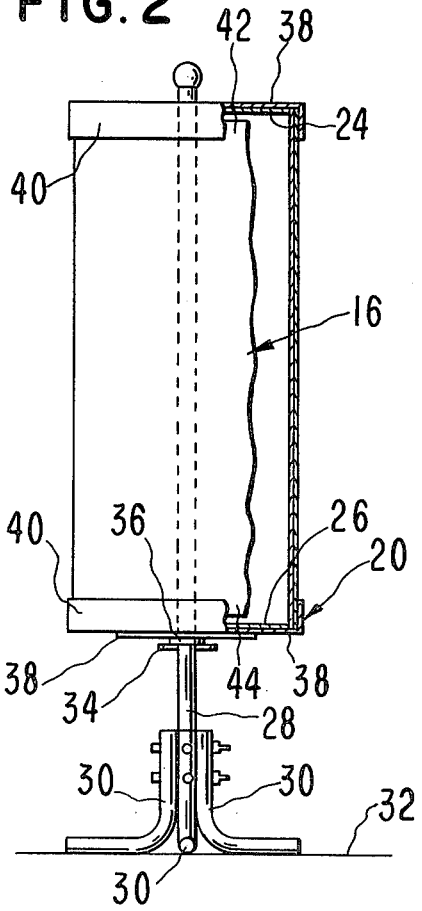
FIG. 3
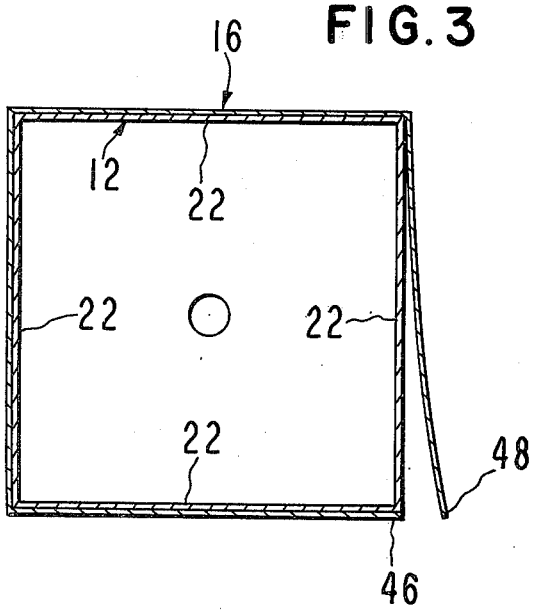

ROTATABLE POSTER DISPLAY UNIT

This invention relates to improvements in the display of graphic materials, such as posters and the like, and, more particularly, to an improved display unit which can have removable backgrounds of different colors.

BACKGROUND OF THE INVENTION

In classrooms of primary and secondary schools, a teacher may often wish to present or to display poster and other art work to students in a manner in which background colors or designs add significantly to the art work itself. For instance, during a change of season, a teacher may wish to have a rust-colored background signifying autumn and light green or green background representing spring. Conventional poster display and display boards, because they are permanent in construction, have a fixed background which cannot be removed from its support. It can be re-painted to change the color of its background or colored sheets can be attached to it; however both of these approaches require considerable time and expense and neither is simple to accomplish in view of the frequent need to change quickly from one background color to another.

SUMMARY OF THE INVENTION

The present invention is directed to an improved rotatable display unit which has an outer sheet, preferably of corrugated material, removably mounted on a core which rotates about a predetermined axis so that the sheet can be readily replaced, such as when the need arises to change from one sheet having a background of a first color to another sheet having a background of a second color. To this end, the core has means thereon for releasably holding the opposed, outer marginal edges of the sheet after the latter has been wrapped around the core so that posters and other art work can be pinned, stapled or otherwise fastened to the sheet while the sheet remains effectively secured to the core.

The holding means comprises a continuous flange for each end of the core, respectively, each flange being operable to clamp the adjacent marginal edge of the sheet against the sidewall of the core. The core can be mounted for rotation about a horizontal axis or a vertical axis and can be varied in height above a floor when mounted for rotation about a vertical axis.

The primary object of this invention is to provide an improved display unit rotatable about a predetermined axis yet the unit is provided with an outer sheet coupled to a central core so that the sheet can be replaced as desired yet the sheet can provide an effective outer removable surface for the core which can be of a specific color, design or texture.

Another object of this invention is to provide a display unit of the type described wherein the sheet is releasably held at its outer marginal edges by an improved holding means to leave substantially the entire surface of the sheet itself for use in displaying posters and other art work, thereby eliminating the need for complicated fastening means for securing the sheet to the core.

Another object of this invention is to provide a display unit of the aforesaid character wherein the unit may be rotatable about a horizontal axis or a vertical axis and can be adjusted with respect to the height above the floor if rotatable about the vertical axis while at the same time the display unit can be made of simple, readily available, inexpensive materials to minimize production and maintenance costs.

Other objects of this invention will become apparent as the following specification progresses, reference being had to the accompanying drawing for an illustration of the invention. In the drawing:

FIG. 1 is a perspective view of the display unit of this invention;

FIG. 2 is a side elevational view of the display unit, parts being broken away and in section to illustrate details of construction; and FIG. 3 is an enlarged horizontal cross section of the display unit.

A poster display unit 10 forming the subject of this invention utilizes a core 12 mounted on a stand 14 and provided with a sheet 16 of perforable material wrapped around the outer surface of the core and held thereto at the ends of the core by a pair of end members 18 and 20.

Core 12 is, for purposes of illustration, square in transverse cross section. However, the core can be of other configurations if desired. Preferably, the core is formed from a cardboard box having sides 22 defining a continuous sidewall therefor. The box forming core 12 is preferably provided with end walls 24 and 26 to permit the box to be properly supported against being collapsed when in use. End walls 24 and 26 hinge outwardly of the positions shown in FIG. 2 so that the box can be collapsed and stored prior to being used.

Stand 14 comprises an upright rod or post 28 having legs 30 secured thereto for mounting rod 28 on a floor surface 32 therebelow. Rod 28 has a cotter pin 34 passing therethrough at any one of a number of spaced locations above legs 30. A washer 36 rests on pin 34 and a place 38 is supported on washer 36.

Lower end member 20 rests on and is supported by plate 38, the latter being rotatable on rod 28 so that core 12, sheet 16 and end members 18 and 20 can rotate about the vertical axis of rod 28.

End members 18 and 20 are substantially identical to each other. Each includes an end wall 38 having a square configuration and provided with sides 40 which provide a continuous flange at the outer periphery of end wall 38. Each end wall 38 is slightly longer on a side than is the corresponding side 22 of core 12. This permits sides 40 corresponding thereto to overlap and to extend along respective sides 22 of core 12 as shown in FIG. 2. Typically, end members 18 and 20 are formed of cardboard.

Sheet 16 is preferably formed from a corrugated material which has an outer surface of a particular color. The upper and lower margins 42 and 44 of sheet 16 is removably tucked or otherwise disposed within the region between sides 40 of end members 18 and 20 and corresponding sides 22 of core 12. In this way, the sheet is releasably connected to the core yet substantially the entire outer surface of the sheet is available for display purposes. While the height of sheet 16 can extend between walls 38 of end members 18 and 20, FIG. 2 shows that the height of the sheet is slightly less than the distance between ends walls 38. Moreover, the length of the sheet is such that it can be wrapped completely around the core as shown in FIG. 3.

In use, core 12 is mounted on rod 28 in the manner shown in FIG. 2. In such a case, lower end member 20 will support the core and will receive the lower margin thereof. Upper end member 18 typically is initially elevated from the position shown in FIG. 2 thereof.

Sheet 16 is then wrapped around the core, beginning with vertical end edge 46 thereof (FIG. 3) until the other end edge 48 is contiguous to end edge 46. Then, the lower margin 44 of sheet 16 is tucked into the space between sides 22 and sides 40 of lower end member 20. Thus, the lower margin 44 of the sheet will be releasably held to the core. Then, the upper margin 42 of sheet 16 is caused to be contiguous to the sides of the core, following which upper end member 18 is lowered so that sides 40 thereof move about upper margin 42 and clamp it to the core. Then the display unit is ready for use. The core with sheet 16 thereon can then be rotated as desired on rod 28.

When it is desired to remove and replace sheet 16, the above steps are reversed, beginning with the lifting of upper end member 18 slightly to release upper margin 42 of sheet 16. Then, the lower margin 44 of the sheet can then be worked out of the space between the core and side 40 of the lower end member 20.

While the display unit has been described as being rotatable about a vertical axis, it can also be rotatable about a horizontal axis if desired. In this case, the sheet 16 would still be attached to the core in the manner described above with respect to FIGS. 1 and 2.

I claim:

1. A display unit comprising: a core of cardboard material, said core having a pair of opposed ends and a generally continuous outer surface; a rod extending through the core and spanning said ends and having first means for positioning the lower end thereof on a supporting surface; a flat plate; a pin extending through the rod, the plate being supported on the pin and disposed for supporting the core on the rod at a location above said first means with said core being rotatable on the rod; a pair of end members shiftably mounted on respective ends of the core, each end member having an end wall and a continuous flange at the outer periphery of the end wall, the flange of one of the end walls being adjacent to and contiguous with the lower end of the core, the flange of the other end wall being adjacent to and contiguous with the upper end of the core; and a perforable, corrugated sheet removably wrapped around the outer surface of the core, the upper and lower marginal edges being releasably received between the flange and the core, whereby the sheet is removably secured to the core.

2. A display unit comprising: a core comprising a cardboard box, said core having a pair of opposed ends and a generally continuous outer surface; a rod extending through the core and spanning said ends and having first means for positioning the lower end thereof on a supporting surface; second means on said rod for supporting the core thereon at a location above said first means with said core being rotatable on the rod; a pair of end members shiftably mounted on respective ends of the core, each end member being of cardboard material and having an end wall and a continuous flange at the outer periphery of the end wall, the flange of one of the end walls being adjacent to and contiguous with the lower end of the core, the flange of the other end wall being adjacent to and contiguous with the upper end of the core; and a perforable, corrugated sheet removably wrapped around the outer surface of the core, the upper and lower marginal edges being releasably received between the flange and the core, whereby the sheet is removably secured to the core.

* * * * *